US010820760B2

(12) United States Patent
Koo

(10) Patent No.: US 10,820,760 B2
(45) Date of Patent: Nov. 3, 2020

(54) COVER FOR TOILET BOWL PROVIDED WITH ROTARY ASSEMBLY

(71) Applicant: Bong Soo Koo, Seoul (KR)

(72) Inventor: Bong Soo Koo, Seoul (KR)

( * ) Notice: Subject to any disclaimer, the term of this patent is extended or adjusted under 35 U.S.C. 154(b) by 48 days.

(21) Appl. No.: 16/340,443

(22) PCT Filed: Oct. 12, 2017

(86) PCT No.: PCT/KR2017/011221
§ 371 (c)(1),
(2) Date: Jun. 17, 2019

(87) PCT Pub. No.: WO2018/105870
PCT Pub. Date: Jun. 14, 2018

(65) Prior Publication Data

US 2020/0163500 A1 May 28, 2020

(30) Foreign Application Priority Data

Dec. 5, 2016 (KR) ..... 10-2016-0164097

(51) Int. Cl.
*A47K 13/12* (2006.01)
*E03D 5/04* (2006.01)

(52) U.S. Cl.
CPC ..... *A47K 13/12* (2013.01); *E03D 5/04* (2013.01)

(58) Field of Classification Search
CPC ..... A47K 13/12; E03D 5/04
USPC ..... 4/236
See application file for complete search history.

(56) References Cited

U.S. PATENT DOCUMENTS 2,021,425 A * 11/1935 Nielsen ..... A47K 13/02 4/236

FOREIGN PATENT DOCUMENTS

| | | |
|---|---|---|
| KR | 20-0118517 | 7/1998 |
| KR | 20-0250108 | 11/2001 |
| KR | 10-0789513 | 12/2007 |
| KR | 10-1201914 | 11/2012 |
| KR | 10-2015-0015688 | 2/2015 |
| KR | 10-2016-0022551 | 3/2016 |

OTHER PUBLICATIONS

International Search Report dated Jan. 19, 2018 for PCT/KR2017/011221.

* cited by examiner

*Primary Examiner* — Huyen D Le

(57) ABSTRACT

The present invention relates to a cover for a toilet bowl comprising: a rotary flange formed at a rear portion; a cover member rotatably coupled to the rotary flange; a toilet seat to which the cover member is coupled; a rotary support panel coupled to the toilet bowl and having a spherical rotary guide groove formed therein; a rotary member coupled to the rotary support panel so as to rotate and connecting the cover member and the toilet seat to the toilet bowl; a rotary assembly provided at the rear of the toilet seat and connected to an end of the rotary member to rotate the rotary member when the positions of the toilet seat and the cover member have been changed; and a water flushing device for operating a water flushing means by using a rotational force.

8 Claims, 3 Drawing Sheets

COVER FOR TOILET BOWL PROVIDED WITH ROTARY ASSEMBLY

This application claims the priority of Korean Patent Application No. 10-2017-0164097, filed on Dec. 5, 2016 in the KIPO (Korean Intellectual Property Office), the disclosure of which is incorporated herein entirely by reference. Further, this application is the National Stage application of International Application No. PCT/KR2017/011221, filed Oct. 12, 2017, which designates the United States and was published in Korean. Each of these applications is hereby incorporated by reference in their entirety into the present application.

TECHNICAL FIELD

The present disclosure relates to a cover for a toilet bowl provided with a rotary assembly. More specifically, the present disclosure relates to a cover for a toilet bowl provided with a rotary assembly capable of managing the cover for a toilet bowl and a seat cleanly, by preventing the contamination of both an inner surface of the cover and inner and outer surfaces of the seat as the dirt is scattered due to water pressure during removal of the dirt in the toilet bowl.

BACKGROUND ART

A toilet bowl is a flush toilet that is designed to allow a user to sit back and relieve himself/herself, and includes a toilet main body having an internal space with an open upper surface to allow defecation, and a water tank connected to the rear of the toilet main body to supply water to the toilet main body.

Such a toilet bowl includes a seat which is hinged at one end to the rear part so as to prevent the user's body from being contaminated when the user sits on the toilet seat, and a cover for covering the toilet seat portion when not in use to prevent the inside thereof from being visible.

In the case of a general toilet bowl, when the user finishes relieving himself/herself and then wants to flush the toilet, seeing even his/her own wastes may cause discomfort, and therefore, the user finishes flushing with the cover closed. At this time, water is injected at a certain water pressure, and the wastes in the toilet bowl are scattered onto the cover and the seat, causing contamination.

Particularly, there is a problem that contamination arises on both the inner surface of the cover and the inner and outer surfaces of the seat that directly come into contact with the user's skin.

In this regard, Korean Patent Laid-Open No. 10-2015-0015688 discloses a cover for a toilet bowl is installed on a main body of the toilet bowl or a seat for a bidet toilet bowl, in which the toilet bowl is rotatable and includes a seat connection part for connecting the seat to a lid of the toilet bowl, or to the main body of the toilet bowl, or to a main body of a bidet, a lower plate seat connected to the seat connection part and supporting an upper plate seat, a rotatable upper plate seat, and a rotary connection part for connecting the upper plate seat so that the upper plate is rotatable on the lower plate seat.

However, in the case of the seat for the toilet bowl described above, since only the left and right rotation of the toilet bowl is allowable, only positions of the cover and the seat are changed, and thus the toilet cannot be properly protected from the scattering wastes.

In addition, since the cover and the seat of the toilet bowl are configured such that they are movable to a limited angle when lifted up for use of the toilet bowl, there is a problem that the cover and the seat may suddenly fall down due to carelessness during use, which inconveniences the user.

DISCLOSURE OF THE INVENTION

Technical Problem

In order to solve such a problem, the present disclosure has been devised in view of the background art described above, and it is an object of the present disclosure to provide a cover for a toilet bowl including a rotary assembly capable of cleanly managing the cover and a seat for the toilet bowl by preventing contamination of both an inner surface of the cover and inner and outer surfaces of the seat when a dirt is scattered due to water pressure during removal of the dirt in the toilet bowl.

Further, it is an object of the present disclosure to provide a cover for a toilet bowl provided with a rotary assembly allowing the user to use the toilet bowl more conveniently by automatically supplying water to the toilet bowl according to a rotating operation of a cover member.

Technical Solution

In order to achieve the above object, according to an embodiment of the present disclosure, the present disclosure may include: a cover member including an opening and closing panel including a rotary flange formed on a rear portion and an upper hinge panel having an upper portion rotatably coupled with the rotary flange; a toilet seat including a lower hinge panel to which a lower portion of the upper hinge panel is coupled; the rotary assembly including a rotary support panel coupled to the toilet bowl and having a spherical rotary guide groove formed therein, a rotary member rotatably coupled to the rotary support panel and connecting the cover member and the toilet seat to the toilet bowl, and a connection flange provided at the rear of the toilet seat and connected to an end of the rotary member to rotate the rotary member when positions of the toilet seat and the cover member are changed; and a water flushing device for operating a water flushing means using a rotational force generated when the toilet seat and the cover member are changed in position, in which the rotary member further includes a rotary ball which is rotated 360° in the rotary guide groove during rotating operation of the toilet seat, a connection shaft extending integrally to the rear of the rotary ball, and a cover connection part which is formed at a rear side end of the connection shaft and rotatably coupled with the connection flange.

According to an embodiment of the present disclosure, the toilet seat is rotated 180° or 360° along a circumferential direction of the connection shaft.

According to an embodiment of the present disclosure, the water flushing device includes a drive sprocket formed on an outer circumferential surface of the rotary ball, a rotary sprocket rotated in left and right directions by a rotational force provided from the drive sprocket, an operation sprocket formed in front of the rotary sprocket, a drive belt connecting the drive sprocket and the rotary sprocket, and an operation belt for connecting the operation sprocket and the water flushing means to operate the water flushing means when the operation sprocket is rotated.

According to an embodiment of the present disclosure, the rotary support panel further includes a shaft through-hole penetrated through a front side of the rotary guide groove to allow rotating operation of the connection shaft in upward and downward directions, in which the shaft through-hole is formed to have a gradually increasing diameter toward a rear side of the rotary support panel.

Advantageous Effects

According to the embodiments of the present disclosure, it is possible to prevent contamination of both an inner surface of a cover and inner and outer surfaces of a cover when a dirt is scattered due to water pressure during removal of the dirt in the toilet bowl, so that there is an effect that the cover and a seat for the toilet bowl can be cleanly managed.

Further, according to the embodiments of the present disclosure, water is automatically supplied to the toilet bowl in accordance with a rotating operation of a cover member, so that the toilet bowl can be used more conveniently.

BEST MODE FOR CARRYING OUT THE INVENTION

A cover for a toilet bowl provided with a rotary assembly is provided, which may include: a cover member including an opening and closing panel including a rotary flange formed on a rear portion and an upper hinge panel having an upper portion rotatably coupled with the rotary flange; a toilet seat including a lower hinge panel to which a lower portion of the upper hinge panel is coupled; and a rotary assembly including a rotary support panel coupled to the toilet bowl and having a spherical rotary guide groove formed therein, a rotary member rotatably coupled to the rotary support panel and connecting the cover member and the toilet seat to the toilet bowl, and a connection flange provided at the rear of the toilet seat and connected to an end of the rotary member to rotate the rotary member when positions of the toilet seat and the cover member are changed, in which the rotary member further includes a rotary ball which is rotated in the rotary guide groove during rotating operation of the toilet seat, a connection shaft extending integrally to the rear of the rotary ball, and a cover connection part which is formed at a rear side end of the connection shaft and rotatably coupled with the connection flange.

MODE FOR CARRYING OUT THE INVENTION

Figure 1:
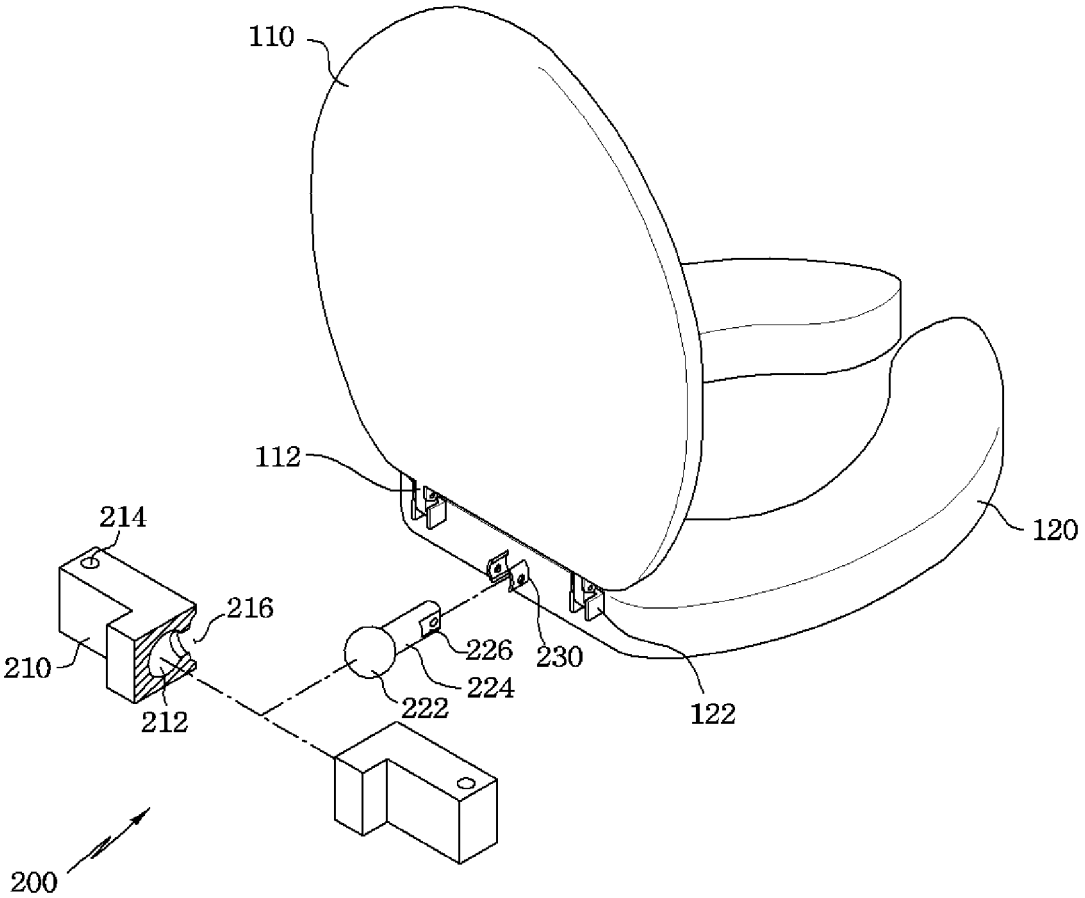
FIG. 1 is an exploded perspective view showing a cover for a toilet bowl provided with a rotary assembly according to an embodiment of the present disclosure.
Figure 2:
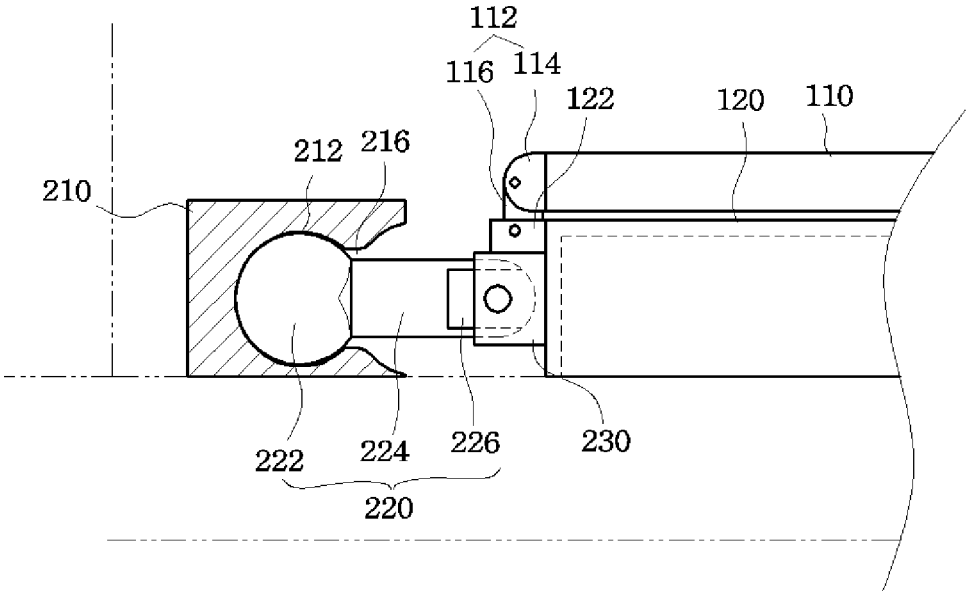
FIG. 2 is a cross-sectional view showing coupled state of the cover for the toilet bowl according to an embodiment of the present disclosure.
Figure 3:
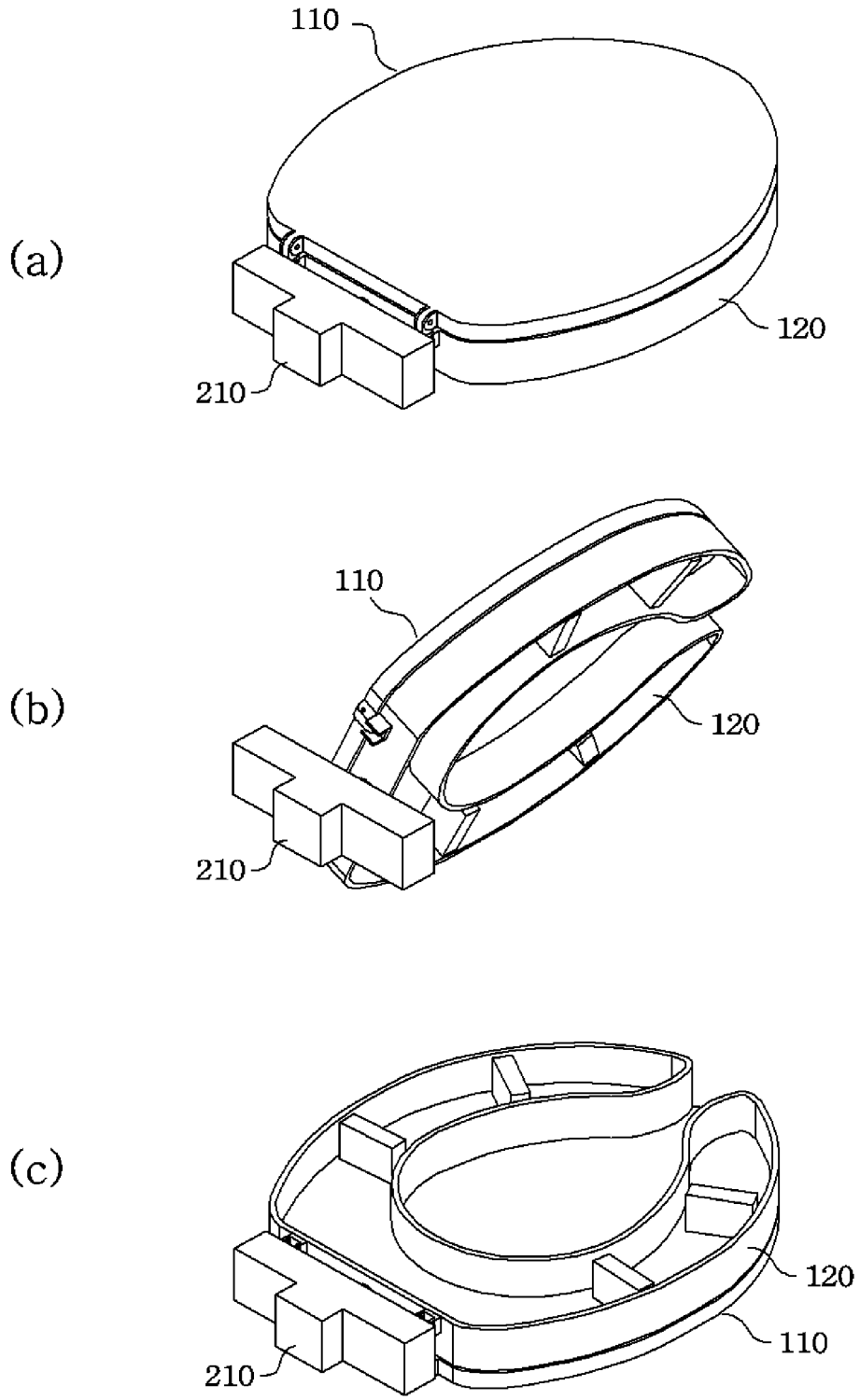
FIGS. 3 and 4 are views showing operation states of the cover for the toilet bowl according to an embodiment of the present disclosure.
Figure 4:
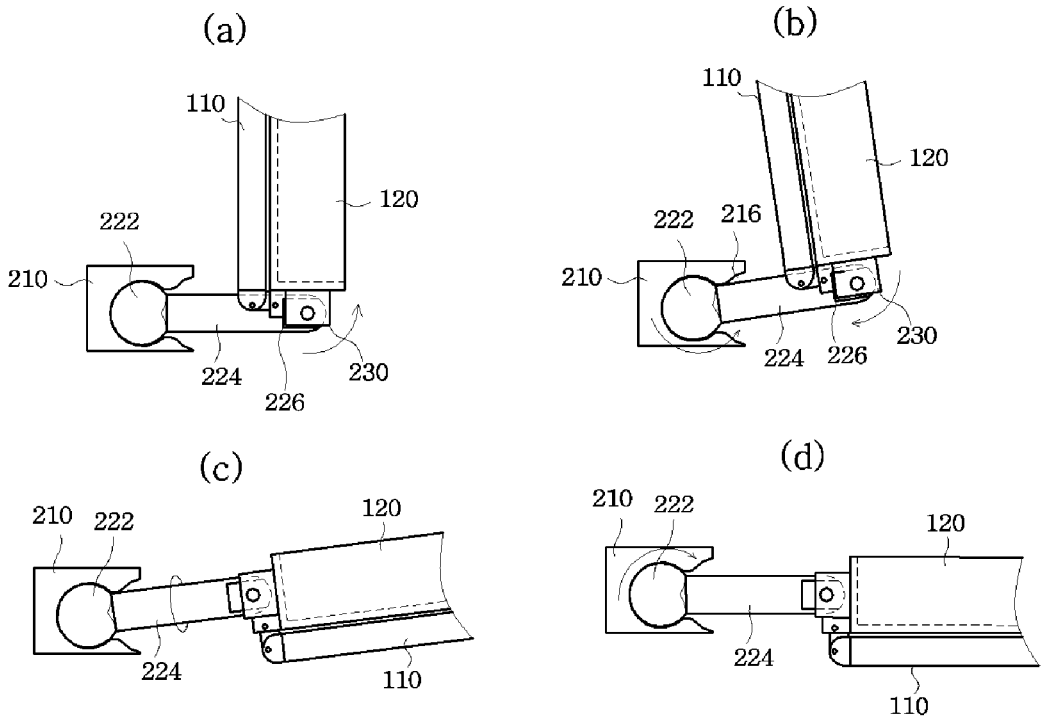
Figure 5:
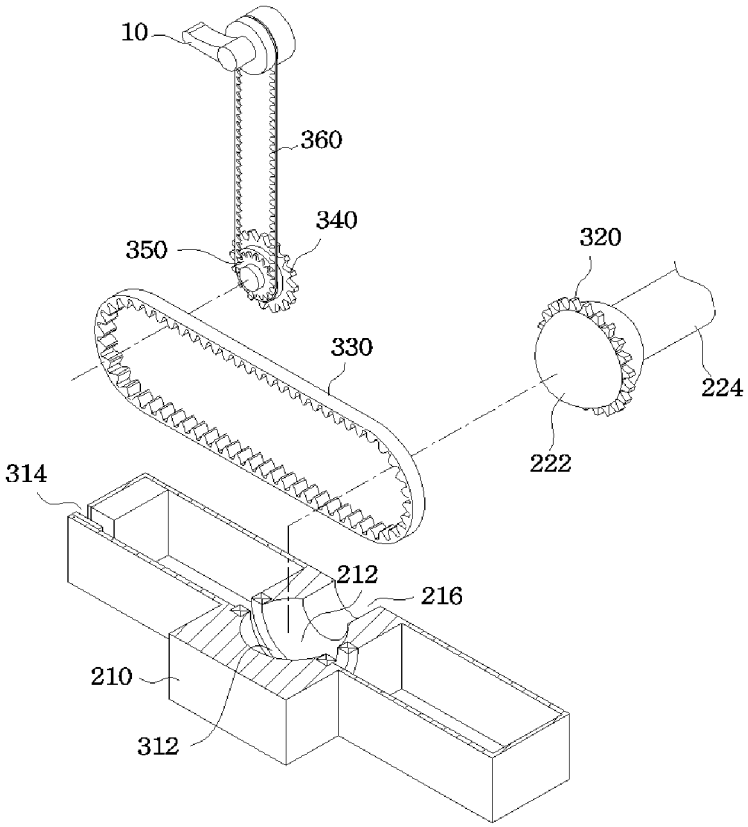
FIG. 5 shows another example of the cover for a toilet bowl according to the embodiment of the present disclosure.

FIG. 1 is an exploded perspective view showing a cover for a toilet bowl provided with a rotary assembly according to an embodiment of the present disclosure, FIG. 2 is a cross-sectional view showing coupled state of the cover for the toilet bowl according to an embodiment of the present disclosure, FIGS. 3 and 4 are views showing operation states of the cover for the toilet bowl according to an embodiment of the present disclosure, and FIG. 5 shows another example of the cover for a toilet bowl according to the embodiment of the present disclosure.

As shown in the drawings, a cover for a toilet bowl according to the present disclosure includes a cover member 110, a toilet seat 120, and a rotary assembly 200.

The cover member 110 closes an upper surface of the toilet seat 120 and includes an opening and closing panel 112 so that the cover member 110 is rotatably coupled with the toilet seat 120.

Here, the opening and closing panel 112 includes a rotary flange 114 integrally formed on a rear portion of the cover member 110, and an upper hinge panel 116 which is rotatably coupled to the rotary flange 114 through a general rotary means such as a hinge or the like and which engages the cover member 110 and the toilet seat 120.

The hinge panel 116 is rotatably coupled with the rotary flange 114 at an upper portion, and is rotatably coupled to the lower hinge panel 122 of the toilet seat 120 at a lower portion, so that the cover member 110 is rotated up and down by a predetermined angle from the toilet seat 120.

The lower surface of the toilet seat 120 is selectively brought into close contact with the upper surface of the toilet bowl, and the upper surface of the toilet seat 120 is directly contacted with the skin of the user during defecation, for example. The toilet seat 120 includes a lower hinge panel 122 to which the upper hinge panel 116 is rotatably coupled so that the cover member 110 can be rotated in the upward and downward directions.

Here, the opening and closing panel 112 and the lower hinge panel 122 may be formed at the center of the rear side of the cover member 110 and the toilet seat 120, or may be formed in shapes corresponding to each other on both sides of the rear side, respectively.

The toilet seat 120 configured as described above is provided with the rotary assembly 200 that is configured to connect the toilet bowl to the cover member 110 and the toilet seat 120, and to change the positions of the cover member 110 and the toilet seat 120 after urination or defecation to prevent the dirt in the toilet bowl from scattering to the outside of the toilet bowl and prevent the dirt from contaminating both the inner surface of the cover member 110 and the inner and outer surfaces of the toilet seat 120.

The rotary assembly 200 includes a rotary support panel 210 which is coupled to the toilet bowl and supports the rotary operation of the cover member 110 and the toilet seat 120, a rotary member 220 which is rotatably coupled to the rotary support panel 210 and connects the cover member 110 and the toilet seat 120 to the toilet bowl, and a connection flange 230 which is coupled to the toilet seat 120 and is connected to an end of the rotary member 220.

The rotary support panel 210 is provided with fastening holes 214 formed at both sides to be coupled to the toilet bowl by fastening means such as fixing bolts, screws, and the like, and is provided with a rotary guide groove 212 that receives a rotary ball 222 of the rotary member 220.

The rotary guide groove 212 is a component that is configured in a shape corresponding to the rotary ball 222, that is, a sphere, to support the rotating operation of the rotary member 220 so that the toilet seat 120 connected to the rotary member 220 is rotated along a circumferential direction of a connection shaft 224 of the rotary member 220.

At this time, the rotary support panel 210 according to the present disclosure is formed with a shaft through-hole 216 penetrated through a front portion of the rotary guide groove 212 such that the connection shaft 224 of the rotary member 220 is inserted thereinto, in which the connection shaft 224 is allowed to rotate up and down by a predetermined angle with respect to the rotary ball 222.

The shaft through-hole 216 is penetrated from the rotary guide groove 212 to the rear side of the rotary support panel 210 and gradually increase in diameter toward the rear side.

Accordingly, as shown in FIGS. 4C and 4D, the cover for a toilet according to the present disclosure may be spaced apart from the toilet bowl by a predetermined distance when the cover member 110 and the toilet seat 120 are changed in position, so that the changes may be carried out more easily.

The rotary member 220 includes the rotary ball 222 in the form of a sphere so as to be rotated 360° in the rotary guide groove 212 of the rotary support panel 210, the connection shaft 224 extending integrally to the rear of the rotary ball 222, and the connection flange 230 formed on the rear surface of the toilet seat 120, with which a leading end of the rear side of the connection shaft 224 is rotatably coupled.

Here, as the connection shaft 224 is rotatably coupled with the connection flange 230 formed on the toilet seat 120 at the leading end of the rear side, the rotary support panel 210 and the toilet seat 120 are coupled.

The connection shaft 224 is provided with the rotary ball 222 at a leading end of the front side, and is also provided with the cover connection part 226 at the end of the rear side to be rotatably coupled with the connection flange 230.

The cover connection part 226 is coupled to the connection flange 230 through a rotary means such as a hinge or the like and is configured to be rotated up and down with respect to the rotary means, so that the toilet seat 120 is rotated from the cover connection part 226.

As shown in FIGS. 4A to 4C, the toilet seat 120 is rotated in the upward and downward directions with respect to a center of axis of the rotary means provided on the connection flange 230.

The connection flange 230 is coupled with the cover connection part 226 formed at the end of the connection shaft 224 in a manner in which the cover connection part 226 is rotatable, so as to serve as a connecting part between the toilet seat 120 with the cover member 110 coupled therewith and the rotary member 220 coupled to the rotary support panel 210.

The connection flange 230 allows the toilet seat 120 to be rotated up and down with respect to the center of axis of the hinge connecting the connection flange 230 and the cover connection part 226.

According to the present disclosure configured as described above, the cover member 110 is configured to be rotated in upward and downward directions by a predetermined angle from the toilet seat 120 by the opening and closing panel 112 and the lower hinge panel 122, and the toilet seat 120 is rotated 180° or 360° along the circumferential direction of the connection shaft 224 of the rotary member 220, such that the outer surface of the cover member 110 closes the opened upper portion of the toilet bowl, so that not only the dirt in the inside of the toilet can be prevented from scattering to the outside, but also both the inner surface of the cover member 110 and the inner and outer surfaces of the toilet seat 120 may be prevented from being contaminated due to the dirt.

Meanwhile, as shown in FIG. 5, the cover for a toilet bowl according to the present disclosure may further include a water flushing device 300 to automatically supply a predetermined amount of water to the inside of the toilet bowl when the cover member 110 and the toilet seat 120 are changed in position by being rotated along the circumferential direction of the connection shaft 224.

The water flushing device 300 serves to supply the water for discharging the dirt into the toilet bowl by operating a water flushing means 10 formed in the toilet bowl using the rotational force generated when the rotary member 220 is rotated in the rotary guide groove 212 of the rotary support panel 210. With this configuration, water is automatically flushed simply by the operation of changing the position of the cover for the toilet bowl, and as a result, the user will be able to use the toilet bowl more conveniently.

Such a water flushing device 300 includes a drive sprocket 320 formed on an outer circumferential surface of the rotary ball 222 provided in the rotary member 220, to transfer the rotational force generated from the rotation of the rotary ball 222, a rotary sprocket 340 rotated in the left and right directions by the rotational force provided from the drive sprocket 320, an operation sprocket 350 formed in the rotary sprocket 340 to operate the water flushing means 10 during rotation of the rotary sprocket 340 while switching the rotational force in the left and right directions to the upward and downward directions, a drive belt 330 for connecting the drive sprocket 320 and the rotary sprocket 340, and an operation belt 360 for connecting the operation sprocket 350 and the water flushing means 10.

In addition, the water flushing device 300 is provided with a first moving hole 312 which is formed in an inner circumferential surface of the rotary guide groove 212 of the rotary support panel 210, and which allows operation of the drive sprocket 320 formed in the rotary ball 222 and the drive belt 330 in mesh with the drive sprocket 320.

In addition, a second moving hole 314 is formed to penetrate through one end of the rotary support panel 210 to allow the drive belt 330 and the rotary sprocket 340 to be engaged with each other.

That is, the drive sprocket 320 is formed inside the rotary support panel 210, and the rotary sprocket 340 is formed outside the rotary support panel 210.

In addition, in the present disclosure, it is needless to say that a cover (not shown) may be further included, which may prevent the rotary sprocket 340, the operation sprocket 350, and the operation belt 360, which are configured outside the rotary support panel 210, from being exposed to the outside.

With the water flushing device 300 described above, when the toilet seat 120 is rotated to change the position of the cover for the toilet bowl, the rotary ball 222 connected to the toilet seat 120 is rotated to rotate the drive sprocket 320, and the drive sprocket 320 transfers the rotational force provided through the rotary ball 222 to the rotary sprocket 340 side through the drive belt 330.

In addition, the rotary sprocket 340 transfers the rotational force to the operation sprocket 350 formed at the front side to operate the operation belt 310 connecting the operation sprocket 350 and the water flushing means 10, so that the water flushing means 10 is moved downward, which causes the water flushing means 10 to be moved downward, thereby supplying a certain amount of water into the toilet bowl.

It is to be understood that the terms "comprise", "include", or "have" as used herein may mean that the component can be inherently included unless specifically stated to the contrary, and therefore, should be construed as further including other elements rather than exclude other components, all terms including technical or scientific terms have the same meaning as commonly understood by one of ordinary skill in the art to which this invention belongs, unless otherwise defined.

In addition, the present disclosure has been described in detail. However, it should be understood that the detailed description and specific examples, while indicating preferred embodiments of the disclosure, are given by way of illustration only, since various changes and modifications within the scope of the disclosure will become apparent to those skilled in the art from this detailed description. Accordingly, the embodiments disclosed in the present disclosure are provided to explain, not to limit a technical art of the present disclosure, and thus, the scope of the present disclosure is not limited. The scope of the present disclosure should be construed by following claims, and every technical art within a same scope of the following claims should be construed to be included in a scope of a right of the present disclosure.

INDUSTRIAL APPLICABILITY

The present disclosure can be applied to a cover for a toilet bowl capable of managing the cover for the toilet bowl and a seat cleanly by preventing the contamination of both an inner surface of the cover and inner and outer surfaces of the seat when the dirt is scattered due to water pressure during removal of the dirt in the toilet bowl.

DESCRIPTION OF REFERENCE NUMERALS

110: cover member
120: opening and closing panel
200: rotary assembly
210: rotary support panel
220: rotary member
222: rotary ball
224: connection shaft
226: cover connection member
230: connection flange
300: water flushing device

The invention claimed is:

1. A cover for a toilet bowl comprising:

a cover member including an opening and closing panel including a rotary flange formed on a rear portion, and an upper hinge panel having an upper portion rotatably coupled with the rotary flange;

a toilet seat including a lower hinge panel to which a lower portion of the upper hinge panel is coupled; and a rotary assembly including a rotary support panel coupled to the toilet bowl and having a spherical rotary guide groove formed therein, a rotary member rotatably coupled to the rotary support panel and connecting the cover member and the toilet seat to the toilet bowl, and a connection flange provided at the rear of the toilet seat and connected to an end of the rotary member to rotate the rotary member when positions of the toilet seat and the cover member are changed, wherein the rotary member further includes a rotary ball which is rotated in the rotary guide groove during rotating operation of the toilet seat, a connection shaft extending integrally to the rear of the rotary ball, and a cover connection part which is formed at a rear side end of the connection shaft and rotatably coupled with the connection flange.

2. The cover for a toilet bowl of claim 1, wherein the toilet seat is rotated 180° or 360° along a circumferential direction of the connection shaft.

3. The cover for a toilet bowl of claim 1, wherein the rotary support panel further includes a shaft through-hole penetrated through a front side of the rotary guide groove to allow rotating operation of the connection shaft in upward and downward directions, wherein the shaft through-hole is formed to have a gradually increasing diameter toward a rear side of the rotary support panel.

4. The cover for a toilet bowl of claim 1, wherein the cover for the toilet bowl further includes a water flushing device for operating a water flushing means using a rotational force generated when the toilet seat and the cover member are changed in position, and wherein the water flushing device includes:

a drive sprocket formed on an outer circumferential surface of the rotary ball;

a rotary sprocket rotated in left and right directions by a rotational force provided from the drive sprocket;

an operation sprocket formed in front of the rotary sprocket;

a drive belt connecting the drive sprocket and the rotary sprocket; and an operation belt for connecting the operation sprocket and the water flushing means to operate the water flushing means when the operation sprocket is rotated.

5. A cover for a toilet bowl comprising:

a cover member including an opening and closing panel including a rotary flange formed on a rear portion, and an upper hinge panel having an upper portion rotatably coupled with the rotary flange;

a toilet seat including a lower hinge panel to which a lower portion of the upper hinge panel is coupled; and a rotary assembly including a rotary support panel coupled to the toilet bowl and having a spherical rotary guide groove formed therein, a rotary member rotatably coupled to the rotary support panel and connecting the cover member and the toilet seat to the toilet bowl, and a connection flange provided at the rear of the toilet seat and connected to an end of the rotary member to rotate the rotary member when positions of the toilet seat and the cover member are changed, wherein the rotary member further includes a rotary ball which is rotated in the rotary guide groove during rotating operation of the toilet seat, and a connection shaft extending integrally to the rear of the rotary ball.

6. The cover for a toilet bowl of claim 5, wherein the toilet seat is rotated 180° or 360° along a circumferential direction of the connection shaft.

7. The cover for a toilet bowl of claim 5, wherein the rotary support panel further includes a shaft through-hole penetrated through a front side of the rotary guide groove to allow rotating operation of the connection shaft in upward and downward directions, wherein the shaft through-hole is formed to have a gradually increasing diameter toward a rear side of the rotary support panel.

8. The cover for a toilet bowl of claim 5, wherein the cover for the toilet bowl further includes a water flushing device for operating a water flushing means using a rotational force generated when the toilet seat and the cover member are changed in position, and wherein the water flushing device includes:

a drive sprocket formed on an outer circumferential surface of the rotary ball;

a rotary sprocket rotated in left and right directions by a rotational force provided from the drive sprocket;

an operation sprocket formed in front of the rotary sprocket;

a drive belt connecting the drive sprocket and the rotary sprocket; and an operation belt for connecting the operation sprocket and the water flushing means to operate the water flushing means when the operation sprocket is rotated.

* * * * *